United States Patent [19]

Boucher

[11] 4,127,196

[45] Nov. 28, 1978

[54] ADJUSTABLE DISPLAY FIXTURE

[75] Inventor: Ralph E. Boucher, Mahwah, N.J.

[73] Assignee: Melrose Displays, Inc., Passaic, N.J.

[21] Appl. No.: 805,795

[22] Filed: Jun. 13, 1977

[51] Int. Cl.[2] ..... A47F 5/10; A47G 5/00

[52] U.S. Cl. ..... 211/207; 211/190; 211/195; 160/351; 160/372; 52/645

[58] Field of Search ..... 211/169, 204, 207, 190, 211/180, 195; 40/125 H, 125 G, 128; 160/218, 219, 230, 184, 194, 351, 372, 374, 375, 381; 248/157; 52/632, 645

[56] References Cited

U.S. PATENT DOCUMENTS

| | | | |
|---|---|---|---|
| 1,159,144 | 11/1915 | Willhoite | 160/372 |
| 1,776,833 | 9/1930 | Huckler | 160/184 |
| 2,246,580 | 6/1941 | Farmer | 160/375 |
| 2,444,288 | 6/1948 | Gilson | 160/374 |
| 2,954,126 | 9/1960 | Middents | 211/190 |
| 3,583,466 | 6/1971 | Dreyer | 160/351 |
| 3,592,288 | 7/1971 | Walter | 160/351 X |

*Primary Examiner*—Roy D. Frazier
*Assistant Examiner*—Terrell P. Lewis
*Attorney, Agent, or Firm*—Lerner, David, Littenberg & Samuel

[57] ABSTRACT

An adjustable display fixture includes a pair of perforated display panels arranged in overlapping relationship on support structure. The support structure telescopes to change the overlap of the pair of panels so that the effective overall panel height is adjustable. To allow the support structure to telescope and provide the overlap feature of the panels, the panels are offset in opposite directions on their respective supports so that the panels do not interfere with the telescoping action of the support structure.

6 Claims, 3 Drawing Figures

ADJUSTABLE DISPLAY FIXTURE

BACKGROUND OF THE INVENTION

This invention relates to display fixtures and, more particularly, to display fixtures wherein the overall height thereof is adjustable.

Display fixtures for displaying merchandise for sale are in wide use. A typical application of such a display fixture is in the area of supermarket check-out counters where a large number of display fixtures are usually provided for displaying merchandise such as magazines. Typically, such a display fixture includes a perforated panel held in a substantially vertical plane by side support members. Magazines pockets are then supported on the panel by means of hooks on the pockets which are adapted to fit through the panel perforations.

One of the problems associated with conventional display fixture construction is the fact that conventional display fixtures have in the past been constructed of a fixed size. If it is desired to change the size of the display fixture, such as to add more magazine pockets, or use larger pockets, the entire display fixture has to be replaced. This is extremely inefficient because either the merchandising establishment or the fixture distributor has to stock a large number of display fixtures of different sizes.

It is therefore an object of this invention to provide an improved display fixture.

It is a further object of this invention to provide a size-adjustable display fixture.

SUMMARY OF THE INVENTION

The foregoing and additional objects are obtained in accordance with the principles of this invention by providing an adjustable display fixture comprising a pair of spaced apart rigid side supports each having a base member and an extension member adapted for arrangement in telescoping relationship, a first planar panel member adapted to be fixedly secured relative to the spaced apart base members, a second planar panel member adapted to be fixedly secured relative to the spaced apart extension members in a plane offset from the plane of the first panel member, and means for telescopically positioning the side supports to a desired extension.

In accordance with an aspect of this invention, each of the panel members has perforations therein and the positioning means includes a pin member adapted to extend through a respective perforation in each of the panel members.

In accordance with another aspect of this invention each of the base members includes a hollow tubular member having an axially aligned slot therein, each of the extension members includes a hollow tubular member having an axially aligned slot therein, and the first and second panel members are adapted to extend through the slots of the base members and the extension members.

In accordance with a further aspect of this invention, the fixture further includes a first transverse member adapted to be connected between the base members and maintain the base members in spaced apart relationship, and a second transverse member adapted to be connected between the extension members and maintain the extension members in spaced apart relationship, the first and second transverse members being sized to maintain the side supports in substantially parallel alignment.

DESCRIPTION OF THE DRAWING

The foregoing will be more readily apparent upon reading the following description in conjunction with the drawing in which.

DESCRIPTION OF THE PREFERRED EMBODIMENT

Figure 1:
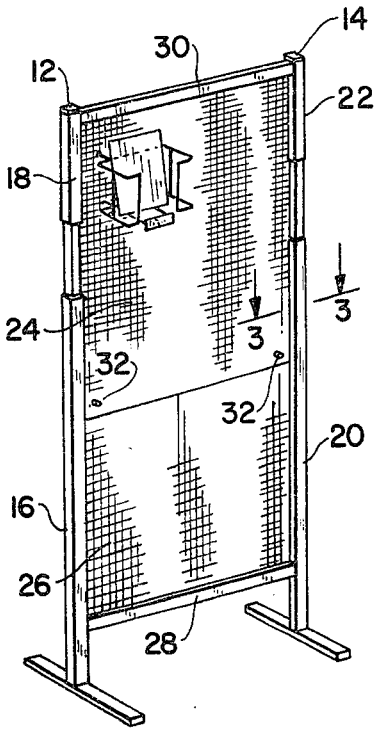
FIG. 1 depicts a perspective view of a display fixture constructed in accordance with the principles of this invention.

Referring now to FIG. 1, depicted therein is an adjustable display fixture 10 constructed in accordance with the principles of this invention. Display fixture 10 comprises a first rigid side support 12 and a second rigid side support 14. Rigid side support 12 includes a base member 16 and an extension member 18. Side support 14 likewise includes a base member 20 and an extension member 22. Base members 16 and 20 are illustratively shown as provided with T-shaped legs for maintaining side supports 12 and 14 in an upright position, but it is apparent that other bottom structures for performing such function may be utilized, such structure not forming a part of this invention.

Display fixture 10 further comprises an upper panel member 24 and a lower panel member 26. Upper panel member 24 is adapted to be fixedly secured relative to extension members 18 and 22 and lower panel member 20 is adapted to be fixedly secured relative to base members 16 and 20. Display fixture 10 also includes a first, or lower, transverse member 28 connected between base members 16 and 20 and a second, or upper, transverse member 30 connected between extension members 18 and 22. Transverse members 28 and 30 are of suitable lengths to maintain side supports 12 and 14 in substantially parallel alignment. As will be described in detail hereinafter, lower panel member 26 is secured to lower transverse member 28 and upper panel member 24 is secured to upper transverse member 30.

Extension members 18 and 22 are adapted to telescope into their respective base members 16 and 20. To allow such telescoping action to occur, panel members 24 and 26 are offset from their respective extension and base members in opposite directions so that there is a region of overlap between panel members 24 and 26. In order to position display fixture 10 at a desired overall extension, pin members 32 are inserted through respective perforations in panel members 24 and 26.

Figure 2:
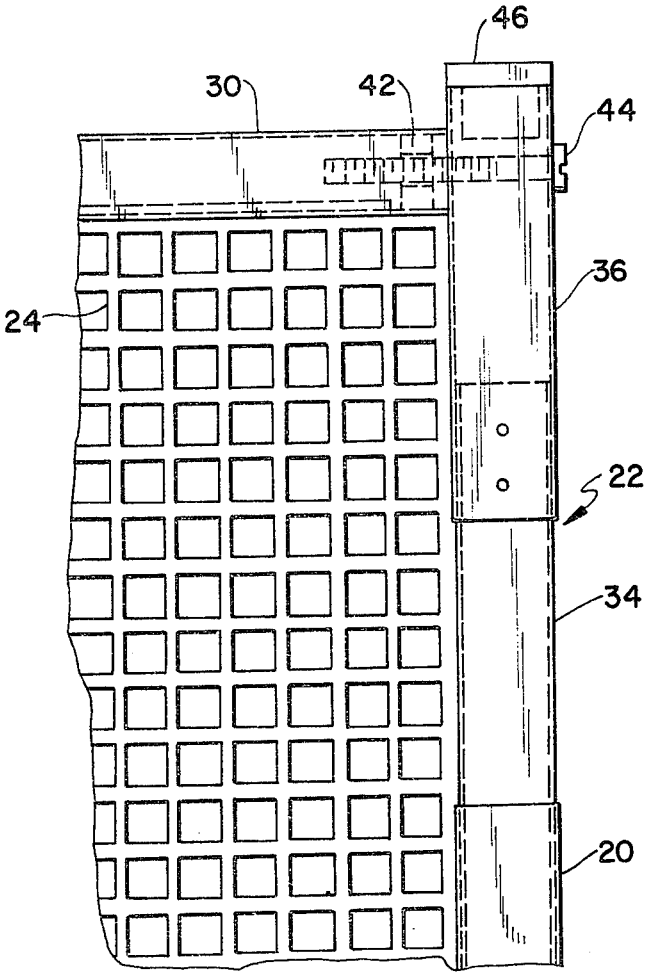
FIG. 2 depicts an enlarged partial view of a corner of the display fixture shown in FIG. 1.
Figure 3:
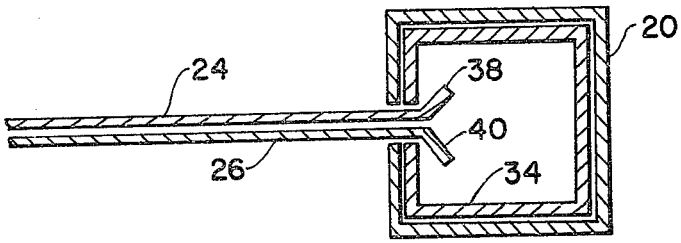
FIG. 3 depicts a cross-sectional view taken along the line 3—3 of FIG. 1.

Referring now to FIGS. 2 and 3, details of an illustrative construction are depicted therein. Base member 20 is illustratively a three quarter inch square open seam tubing made of eighteen gauge metal. Extension member 22 is illustratively a five eighth inch square open seam tubing 34 made of eighteen gauge metal which fits within base member 20 for telescoping action relative thereto. Extension member 22 also includes a length 36 of three quarter inch open seam tubing of eighteen gauge metal which is secured to tubing 34, illustratively by spot welding. The seams of base member 20 and extension member 22 are axially aligned so that panel members 24 and 26, illustratively perforated metal background panels made of sixteen gauge metal, extend through the seams, or slots, of both base member 20 and extension member 22. The ends 38 and 40 of panels 24 and 26, respectively, are bent out of the plane of the panels, as shown in FIG. 3, to trap the panels within the tubing.

Transverse member 30, shown in FIG. 2, and transverse member 28 are similarly constructed of three quarter inch square open seam tubing of eighteen gauge metal. Upper panel 24 extends through the seam of upper transverse member 30 and its end is bent to trap the panel within the transverse member. Similarly, lower panel 26 extends through the seam of lower transverse member 28 and has its end bent to trap panel member 26 within lower transverse member 28. Upper transverse member 30 is connected to length 36 of extension member 22 illustratively by means of nut 42 and bolt 44, as shown in FIG. 2. The end of upper transverse member 30 is similarly connected to extension member 18. Likewise, lower transverse member 28 is connected to base members 16 and 20. The open end of tubing 36 is illustratively capped by a plastic tip 46, and a similar arrangement is utilized for extension member 18. Thus, panels 24 and 26 are effectively secured with respect to their respective three sided frame comprising base members 16 and 20 and lower transverse member 28 (for the lower panel 26) and extension members 18 and 22 and upper transverse member 30 (for upper panel 24).

Accordingly, upper panel member 24 is fixedly secured relative to extension members 18 and 22 and upper transverse member 30, and lower panel member 26 is fixedly secured relative to base members 16 and 20 and lower transverse member 28. Thus, when it is desired to change the height of display fixture 10, all that need be done is to remove pin members 32 and raise or lower upper panel 24, secured to its support structure comprising extension members 18 and 22 and upper transverse member 30, and then reinsert pin members 32 when upper panel member 24 is at a desired extension.

Accordingly, there has been disclosed an adjustable display fixture. Although a preferred embodiment has been disclosed herein, it is apparent that variations and modifications of the illustrative embodiment may be made without departing from the spirit and scope of this invention, as defined by the appended claims.

What is claimed is:

1. An adjustable display fixture comprising: a pair of spaced apart rigid side supports each having a base member and an extension member arranged in a telescoping relationship;

a first planar panel member having perforations formed therein and fixedly secured relative to said spaced apart base members;

a second planar panel member having perforations formed therein and fixedly secured relative to said spaced apart extension members in a plane offset from the plane of said first panel member, said second panel member at least partially overlapping said first panel member; and means for telescopically positioning said extension members relative to said base members including a removable pin member for insertion into aligned perforations in the overlapping portion of said panel members.

2. A fixture according to claim 1 wherein each of said base members includes a hollow tubular member having an axially aligned slot therein, each of said extension members includes a hollow tubular member having an axially aligned slot therein and aligned with the slot of said base members, and said first and second panel members extending through the aligned slots of said base members and said extension members.

3. A fixture according to claim 2 wherein the ends of said panel members which extend through said aligned slots and into the respective base and extension members are bent out of the plane of the panels.

4. A fixture according to claim 2 further including:

a first transverse member connected between said base members to maintain said base members in spaced apart relationship; and a second transverse member connected between said extension members to maintain said extension members in spaced apart relationship, said first and second transverse members being sized to maintain said side supports in substantially parallel alignment.

5. A fixture according to claim 4 wherein each of said first and second transverse members includes a hollow tubular member having an axially aligned slot therein, said first panel member extending through the slot of said first transverse member, and said second panel member extending through the slot of said second transverse member.

6. A fixture according to claim 5 wherein the ends of said panel members which extend through the respective transverse member slots and into the respective transverse members are bent out of the plane of the respective panels.

* * * * *